United States Patent [19]

Parker, Jr.

[11] Patent Number: 4,483,208

[45] Date of Patent: Nov. 20, 1984

[54] PUMPING UNIT

[76] Inventor: Thomas N. Parker, Jr., P.O. Box 356, Boswell, Okla. 74727

[21] Appl. No.: 394,505

[22] Filed: Jul. 2, 1982

[51] Int. Cl.[3] ..... F16H 21/32

[52] U.S. Cl. ..... 74/41; 74/40; 74/103

[58] Field of Search ..... 74/40, 41, 103, 108, 74/522

[56] References Cited

U.S. PATENT DOCUMENTS

| | | | |
|---|---|---|---|
| 1,122,818 | 12/1914 | Trainer | 74/40 |
| 1,979,803 | 11/1934 | Livingston | 74/41 X |
| 2,054,655 | 9/1936 | Humphrey | 74/103 |
| 2,161,252 | 6/1939 | Gunsaullus | 74/103 |
| 2,348,241 | 5/1944 | Bridwell | 74/41 |
| 3,208,291 | 9/1965 | Ross | 74/41 |
| 3,221,569 | 12/1965 | Ross | 74/108 |
| 3,277,730 | 10/1966 | Chastain | 74/41 |
| 4,121,471 | 10/1978 | Chancellor | 74/41 |
| 4,161,137 | 7/1979 | Gaddy | 92/13 |
| 4,377,092 | 3/1983 | Garmong | 74/41 |

*Primary Examiner*—Leslie A. Braun

*Assistant Examiner*—Dwight G. Diehl

*Attorney, Agent, or Firm*—Head, Johnson & Stevenson

[57] ABSTRACT

A pumping unit such as used on an oil well, the unit having a base, an upright sampson post supported on the base, a drum rotatably supported to the sampson post, the drum being rotatable about its horizontal axis, a lever arm pivoted to the base and in a direction to and away from the vertical sampson post, a weight arm pivotally affixed at one end to the upper end of the lever arm, a counterweight affixed to the outer end of the weight arm, a cable extending over the drum having one end secured to the lever arm and the other end hanging in a vertical position from the drum and adapted to be attached to pumping equipment such as an oil well polish rod, a gearbox driven crank arm connected by a pitman arm to the lever arm to pivot the lever arm back and forth towards and away from the sampson post to thereby cause the cable to reciprocate over the drum and a linkage connected to the weight arm to cause it to pivot as the lever arm is pivoted so that the counterweight reacts to offset the weight of pumping equipment attached to the cable.

8 Claims, 3 Drawing Figures

PUMPING UNIT

SUMMARY OF THE INVENTION

A pumping unit for use in pumping an oil well is provided. While the pumping unit may also be used for water wells, it is most particularly adapted for pumping oil wells which may be several thousand feet deep as compared to the relatively shallower depth of water wells. The pumping unit includes a base which is supported on the surface of the earth adjacent a well. Mounted on the base is a vertical sampson post, and affixed to the top of the sampson post is a drum, in the shape of a wheel, which is rotatable about a horizontal axis. A lever arm has a lower end pivotally secured to the base adjacent to but spaced away from the sampson post, the lever arm being pivotal in a vertical plane to and away from the sampson post. A cable is attached to the lever arm and extends over the drum and has an end portion which hangs vertically directly over the well to be pumped. The lower end of the cable is adapted to be affixed to pumping equipment such as a polish rod or the like. The pumping unit functions to raise and lower the cable vertically to cause the pumping of the well.

Pivotally attached to the upper end of the lever arm is a weight arm which also pivots in a vertical plane. A counterweight is secured adjacent the outer end of the weight arm. A stiff arm is hinged at one end to the sampson post and at the other end to the weight arm so that as the lever arm is pivoted back and forth to and away from the sampson post the weight arm is pivoted relative to the lever arm to raise and lower the counterweight. A vector force generated by the counterweight is applied to the lever arm which in turn is applied to the cable so as to counteract and effectively balance the weight of the pumping equipment attached to the lower end of the cable.

The pumping unit is actuated by a mechanism causing the lever arm to pivot back and forth to and away from the sampson post. This can be accomplished by means of crank arms extending from a gearbox supported on the base. The gearbox has a horizontal output shaft which rotates in response to power input to the gearbox which may be supplied by an electric motor or by an engine. Extending from the outer end of the crank arms are pitman arms connecting to the lever arm so that as the crank arms rotate the pitman arms are reciprocated back and forth to thereby pivot the lever arm and thus the cable to impart vertical pumping action to well pumping equipment.

DETAILED DESCRIPTION

Figure 1:
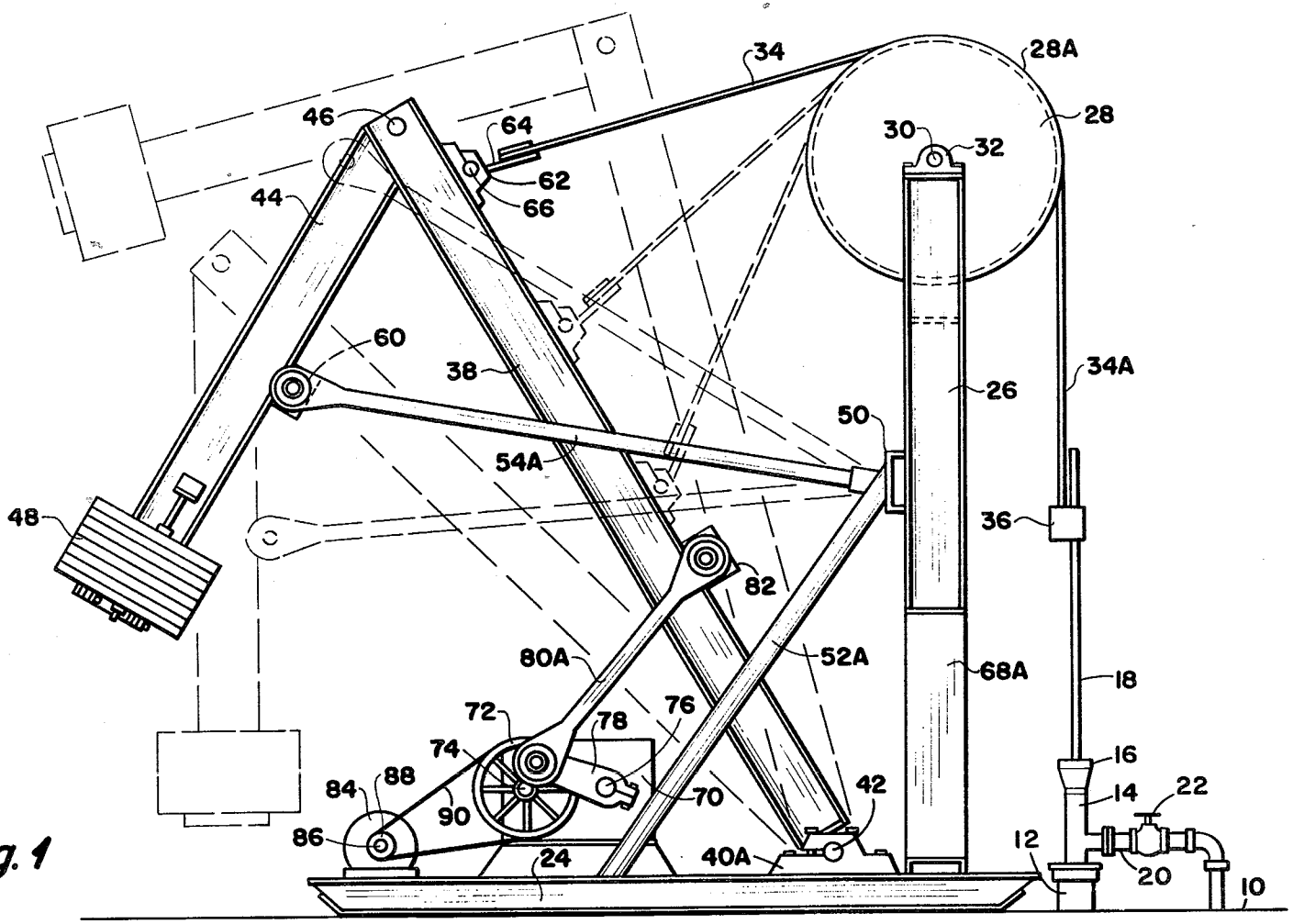
FIG. 1 is an elevational view of an embodiment of the invention disclosing the basic elements making up a pumping unit which employs the principle of this invention.

Many oil reservoirs when first penetrated by boreholes have a sufficient reservoir pressure to cause fluid therein to flow to the surface. However, after some length of time, which may be short or long depending on the nature of the reservoir, the pressure of the reservoir decreases to the point where fluid is not forced to the surface. Some reservoirs while containing large volumes of oil do not have sufficient pressure to force the oil to the surface. When oil exists in an underground reservoir and insufficient pressure exists to force it to the surface, some means must be provided to pump the oil from the reservoir to the earth's surface. There are many types of pumps in use, such as electric driven bottom hole centrifugal pump, gas lift pumps, etc.; however, the most commonly employed type of pumping unit for lifting oil from an underground reservoir to the earth's surface is that in which a vertically reciprocated pump is positioned in a tubing in the well with a string of sucker rods extending to the earth's surface and in which the sucker rods are vertically reciprocated to cause pumping action to pump the fluid to the earth's surface within the tubing. In the typical arrangement, at the surface of the well there is a stuffing box which closes off the tubing extending to the earth's surface and a polish rod is reciprocated in the stuffing box. A string of sucker rods are attached to the lower end of the polish rod, and these extend to a pump within the tubing at the bottom of the well. The apparatus which is used to vertically reciprocate the polish rod, and thereby the pumping equipment including the string of sucker rod and the bottom hole pump, is referred to in the oil industry as an "pumping unit". It is to this type of pumping unit that the present invention is directed.

Many types of pumping units have been suggested, and as an indication of the state of the art, reference may be had to the following U.S. Pat. Nos. 3,211,569; 2,054,655; 2,161,252; 1,979,803; 2,087,785; 3,208,291; and 4,161,137. This list of patents is by no means exhaustive but is merely exemplary of other types of pumping units which have been suggested.

One requirement of an effective pumping unit is that the total amount of energy employed to reciprocate the string of sucker rods in a well be as small as possible. In addition, the stress and strain on the pumping unit to reciprocate a long string of sucker rods and a column of fluid requires that some counterweight mechanism be provided to offset the weight of the pumping equipment. The present invention is particularly directed towards a type of pumping unit having an improved counterweight action to more effectively and efficiently offset the weight of pumping equipment and in an arrangement wherein effective pumping action is achieved. Another advantage of the present invention is that it provides a pumping unit in which a great variety of different lengths of pump strokes may be accomplished by rather simple mechanism adjustments while at the same time effective counterweight action is achieved.

Referring first to FIG. 1, the earth's surface is indicated by the numeral 10. Extending from the earth's surface is a casing 12 in an oil well. Out of the casing extends the upper end of a string of tubing 14 and at the top of the tubing is a stuffing box 16. Reciprocally received in the stuffing box 16 is a polish rod 18, the lower end of which is attached to a length of sucker rods (not shown) and at the lower end of the sucker rods there a pump is attached (not shown). By reciprocation of the polish rod 18, pumping action is achieved and oil, including oil mixed with water, is pumped from the subsurface formation and is caused to flow into a lead line 20 which connects to a tank battery (not shown) or other means of receiving and containing produced petroleum, or to equipment which separates the oil and water. A valve 22 is employed to close off the lead line 20.

The elements described to this point are not part of the invention but are merely exemplary of typical pumping well to which the present invention is applied. The pumping unit which will now be described has the function of vertically reciprocating the polish rod 18 to achieve pumping action. The pumping unit includes a base 24 typically made of structural members resting on the earth's surface 10 adjacent the well casing 12. Supported on the front of the base is a vertical sampson post 26 which may be formed of a variety of structural members welded or bolted together. At the upper end of the sampson post a drum 28 is supported. The drum is positioned to rotate about its horizontal axis 30 and may be supported at the upper end of sampson post 26 by opposed pillow blocks 32. The drum 28 has a peripheral surface 28A adapted to receive a cable 34 thereover. The cable may be in the form of a single length cable or, as illustrated, a double cable, and the peripheral surface 28A may include grooves formed in the drum to receive the double cable. The pumping unit functions by reciprocating cable 34 so that the lower end portions 34A which hang vertically from drum 28 may be attached to the polish rod 18 by a polish rod clamp 36, an item not illustrated in detail but which is well known in the industry.

Supported on the base 24 is a lever arm 38. The lower end is pivotally supported to the base such as by the means of pillow blocks 40A and 40B which support a horizontal shaft 42 received by the lower end of the lever arm. The upper end of the lever arm 38 has attached to it a weight arm 44 such as by means of a pin 46. Thus the lever arm 38 is pivotal in a vertical plane back and forth towards and away from the sampson post 26; and in like manner, the weight arm 44 is pivotal in a vertical plane relative to the upper end of the lever arm.

Secured to the outer or lower end of weight arm 44 is a counterweight 48. The position of the counterweight on the weight arm 44 may be varied as well as the total amount of the weight by means which is typically employed in the manufacture of pumping units.

A cross member 50 is affixed to the sampson post and is supported in a horizontal plane. Extending from base 24 to the outer ends of the cross member are braces 52A and 52B. Pivotally attached to cross member 50 is a stiff arm 54. In the illustrated arrangement the stiff arm 54 consists of two parallel members 54A and 54B. Each is pivotally attached to cross member 50 by means of a pillow block or similar type bearing arrangement 56 so that the inner ends of the stiff arms 54A and 54B pivot about a horizontal shaft 58. The outer ends of the stiff arms are attached to the weight arm 44 by means of a shaft 60. The shaft 60 is in a horizontal plane and is bolted to the weight arm 44 so that it can be easily attached to different positions of the weight arm. In this way the geometry of the weight arm can be effectively adjusted so that the action of the counterweight can be varied as necessary to most effectively function to counterbalance the weight of the pumping equipment attached to polish rod 18. In this manner the pumping unit can be adjusted so as to apply a substantially constant load on the prime mover utilized to apply energy to the pumping unit which will be described subsequently.

Figure 3:
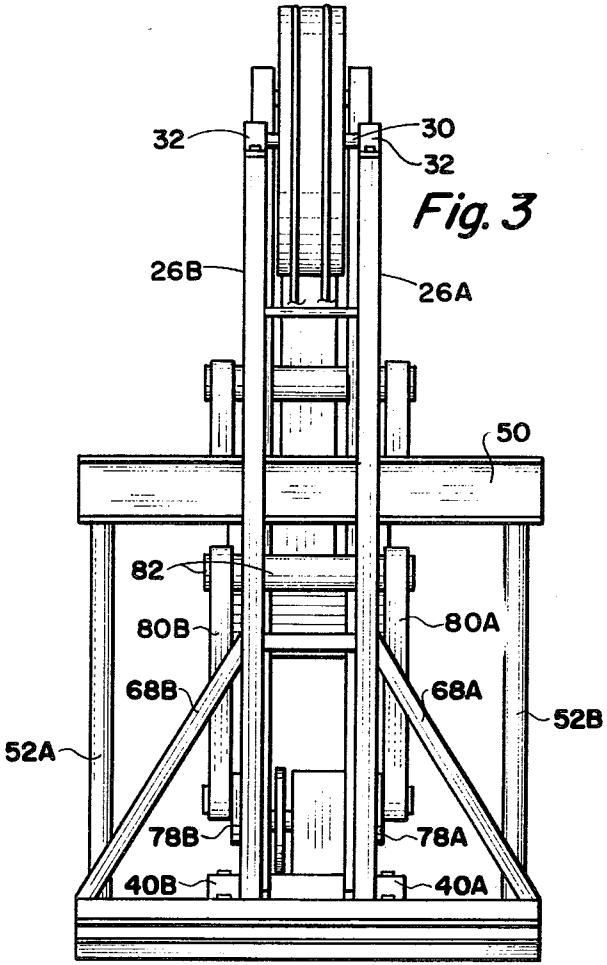
FIG. 3 is a front elevational view of the pumping unit of FIG. 1.
Figure 2:
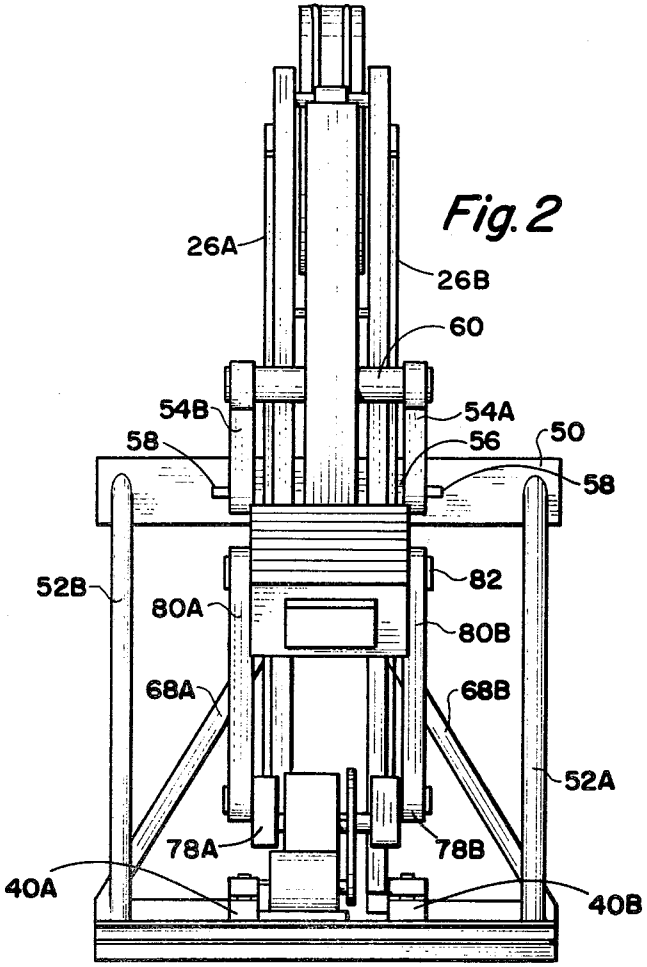
FIG. 2 is a rearward elevational view of the pumping unit of FIG. 1.

The pumping unit of this invention is particularly adaptable to various adjustments. In addition to changing the amount and position of weight 48 and the point of attachment of the stiff arms to the weight arm 44 to change the geometry of action of the counterweight, the length of stroke applied to cable 34, and thereby to polish rod 18, may be easily adjusted by changing the position of the point of attachment of cable holder 62 to the lever arm 38. The cable holder 62 is preferably bolted to the arm 38 so that it can be moved up and down to various positions as shown in dotted outline in FIG. 1. In a preferred arrangement the cable holder includes an extension portion 64 which is pivotally secured to the cable holder by means of a pin 66. The extension 64 includes a portion which receives a loop of the cable 34 so that the cable is in effect doubled, as shown in FIGS. 2 and 3, with both ends being attached to the polished rod clamp 36.

The pumping unit can be fabricated primarily of readily available structural members such as H beams, channels, T beams, etc. For instance, the sampson post 26 can very effectively formed of two spaced apart channel members indicated by the letters 26A and 26B in FIGS. 2 and 3 with bracing therebetween. To help support the sampson post 26 in the vertical position, lateral braces 68A and 68B may be employed. While the components of the invention may be constructed in a variety of ways, the invention is not directed to such structural details but is directed towards the basic concepts of the elements as exemplified in the drawings regardless of the particular manner in which they are formed.

Positioned on base 24 is a gearbox 70 of a type commonly employed on oil well pumping units. The gearbox 70 receives input energy to a sheave 72 connected to a drive shaft 74. By means of gears (not shown) within the gearbox 70 speed reduction of the drive shaft 74 is accomplished to drive an output shaft 76 which extends in a horizontal plane and to both sides of the gearbox. Attached to the opposite ends of drive shaft 76 are crank arms 78A and 78B. Pivotally attached to the outer end of the crank arms 78A and 78B are pitmans 80A and 80B. The outer ends of the pitmans 80A and 80B are pivotally attached to the lever arm 38 by means of an equalizer bar 82. In this manner both the inner and outer ends of the pitmans 80A and 80B are supported by bearings. The point of attachment of the equalizer bar 82 may be varied up and down on the lever arm so that the pumping action of the unit may be adjusted. The length of stroke of the pumping unit may be adjusted in this manner as well as by the adjustment of the point of attachment of the cable holder 62.

To provide prime energy to drive the pumping unit an electric motor 84 is mounted on base 24 having an output shaft 86 and sheave 88 driving the belt 90 which in turn drives the gearbox sheave 72. Motor 84 is exemplary and may be replaced by an engine or other prime mover source.

The pumping unit illustrated and described herein provides an effective and economically constructed device for producing vertical reciprocal motion to the polish rod 18 to actuate pumping equipment in a well. The pumping unit is unique in the great flexibility of arrangements by which the length of the pumping unit stroke may be varied and in the geometrical action of the coupling of the drive energy to produce reciprocal action so as to enable an operator to "fine tune" the pumping unit to the particular stroke length and weight of pumping equipment so that the energy required by prime mover 84 is substantially constant. In addition, by the adjustable features of the pumping unit the shock load placed on the gearbox 70, and thus on the prime mover, can be minimized so that the wear and tear on these items of equipment are reduced to ensure a longer useful life.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. A pumping unit comprising:

a horizontal base for supporting on the earth;

an upright sampson post having the lower end secured to said base;

a drum rotatably supported to the top of said sampson post;

a gearbox secured to said base and spaced from said sampson post, the gearbox having a horizontal driveshaft extending therefrom;

a crank arm having the inner end affixed to and rotated by said drive shaft in a vertical plane;

a lever arm having the lower end pivotally supported to said base at a position between said gearbox and said sampson post, the lever arm being pivotal in a vertical plane, the outer end of arm being pivotally attached by means of a pitman to said lever arm intermediate its upper and lower end;

a cable extending over said drum and having one end affixed to said lever arm and the other end attachable to a vertically reciprocal pumping element, such as a polish rod;

a weight arm having a first end pivotally affixed to said lever arm, the weight arm being pivotal in a vertical plane relative to said lever arm;

a stiff arm having one end pivotally affixed to said sampson post and the other end pivotally affixed to said weight arm; and means to provide energy to said gearbox to rotate said shaft to thereby cause said lever arm to rock back and forth, causing said cable to be pulled back and forth over said drum, the angular position of said weight arm being controlled by said stiff arm.

2. The pumping unit according to claim 1 wherein longitudinal position of attachment of said cable to said lever arm is selectable.

3. The pumping unit according to claim 1 wherein the point of attachment of said stiff arm to said weight arm is longitudinally selectable.

4. A pumping unit comprising:

a base;

an upright sampson post supported on said base;

a drum supported to said sampson post at the upper end thereof, the drum being rotatable about a horizontal axis;

a lever arm having an upper and lower end, the lower end being pivotally supported to said base, the lever arm being pivotal to and away from said sampson post in a vertical plane;

a weight arm having a first and second end, the first end being pivotally attached to said lever arm adjacent the upper end thereof, the weight arm being pivotal in the vertical plane of said lever arm;

a counterweight affixed to said weight arm adjacent the second end thereof;

a cable extending over said drum, the cable having one end affixed to said lever arm and the other end portion extending vertically and adapted to be attached to a pumping element, such as a polish rod;

means to cause cyclic pivotation of said lever arm towards and away from said sampson post to thereby raise and lower said cable second end portion; and linkage means controllably varying the angular relationship of said weight arm with said lever arm as said lever arm is cyclically pivoted to thereby controlly apply a counterweight to the pivotation of said lever arm opposite to the force applied by said cable.

5. A pumping unit according to claim 4 wherein said means of cyclical pivotation of said lever arm includes a crank arm rotatably supported at one end about a horizontal axis; and a pitman extending from said crank arm and pivotally connected to said lever arm.

6. A pumping unit according to claim 4 wherein said means to cause cyclic pivotation of said lever includes a gearbox having a horizontal output shaft;

a crank arm affixed at one end to said output shaft, the crank arm being rotated in a vertical plane;

a pitman extending from the outer end of said crank arm to said lever arm; and means to apply rotational energy to said gearbox to rotate said output shaft.

7. The pumping unit according to claim 4 wherein longitudinal position of attachment of said cable to said lever arm is selectable.

8. The pumping unit according to claim 6 wherein said linkage means for varying the angular relationship of said weight arm weight to said lever arm includes a stiff arm pivotally attached at one end to said weight arm and at the other end to said sampson post.

* * * * *